US009349556B2

(12) United States Patent
Yoshitomo et al.

(10) Patent No.: US 9,349,556 B2
(45) Date of Patent: May 24, 2016

(54) GAS CIRCUIT BREAKER

(75) Inventors: Yuji Yoshitomo, Tokyo (JP); Ishinori Ochiai, Tokyo (JP); Daisuke Yoshida, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/390,851

(22) PCT Filed: May 31, 2012

(86) PCT No.: PCT/JP2012/064158

§ 371 (c)(1),
(2), (4) Date: Oct. 6, 2014

(87) PCT Pub. No.: WO2013/179456

PCT Pub. Date: Dec. 5, 2013

(65) Prior Publication Data

US 2015/0053647 A1 Feb. 26, 2015

(51) Int. Cl.
*H01H 33/64* (2006.01)
*H01H 33/56* (2006.01)
(Continued)

(52) U.S. Cl.
CPC ..... *H01H 33/565* (2013.01); *H01H 33/42* (2013.01); *H01H 33/64* (2013.01); *H01H 33/021* (2013.01); *H01H 2033/426* (2013.01)

(58) Field of Classification Search
CPC ..... H01H 33/666; H01H 33/42; H01H 3/32
See application file for complete search history.

(56) References Cited

U.S. PATENT DOCUMENTS 3,300,610 A * 1/1967 Roth ..... H01H 3/60 200/82 B
3,890,479 A * 6/1975 Thuries ..... H01H 33/83 218/88

(Continued)

FOREIGN PATENT DOCUMENTS

JP 49-035896 A 4/1974
JP 55-111113 U1 8/1980

(Continued)

OTHER PUBLICATIONS

International Search Report (PCT/ISA/210) mailed on Jun. 26, 2012, by the Japanese Patent Office as the International Searching Authority for International Application No. PCT/JP2012/064158.

(Continued)

*Primary Examiner* — Truc Nguyen
(74) *Attorney, Agent, or Firm* — Buchanan Ingersoll & Rooney PC

(57) ABSTRACT

A piston rod includes a large-diameter portion that is formed on the side of a movable contact, and a small-diameter portion that is formed on the side of an insulating operation rod relative to the large-diameter portion, and that is formed with an outer diameter smaller than the inner diameter of an inner peripheral surface of an insulating cylindrical member. The insulating cylindrical member includes a cylindrical portion that is interposed between the outer peripheral surface of the small-diameter portion and the inner peripheral surface of the insulating operation rod, a bottom portion that is arranged opposed to the distal end of the small-diameter portion, and a through hole through which a coupling pin is inserted through the piston rod and the insulating operation rod.

10 Claims, 3 Drawing Sheets

(51) Int. Cl.
*H01H 33/42* (2006.01)
*H01H 33/02* (2006.01)

(56) References Cited

U.S. PATENT DOCUMENTS

| | | | | | |
|---|---|---|---|---|---|
| 5,367,134 | A * | 11/1994 | Yoshizumi | H01H 33/34 | 218/84 |
| 5,451,731 | A * | 9/1995 | Yoshizumi | H01H 33/168 | 218/143 |
| 5,508,487 | A * | 4/1996 | Smith | H01H 3/3031 | 200/400 |
| 5,742,017 | A * | 4/1998 | Perret | H01H 33/166 | 218/143 |
| 5,837,953 | A * | 11/1998 | Ito | H01H 33/18 | 218/22 |
| 7,078,643 | B2 * | 7/2006 | Rostron | H01H 33/166 | 218/144 |
| 7,763,821 | B2 | 7/2010 | Yoshitomo et al. | | |
| 2012/0138574 | A1 | 6/2012 | Yamamoto et al. | | |
| 2013/0057083 | A1 * | 3/2013 | Donzel | H01H 33/14 | 307/112 |

FOREIGN PATENT DOCUMENTS

| | | | |
|---|---|---|---|
| JP | 58-030226 | U1 | 2/1983 |
| JP | 58-079819 | U1 | 5/1983 |
| JP | 3-26943 | U | 3/1991 |
| JP | 6-318415 | A | 11/1994 |
| JP | 9-326223 | A | 12/1997 |
| JP | 11-126545 | A | 5/1999 |
| JP | 2000-11823 | A | 1/2000 |
| JP | 2003-16883 | A | 1/2003 |
| JP | 2006-333567 | A | 12/2006 |
| JP | 2007-305360 | A | 11/2007 |
| JP | 2010-225532 | A | 10/2010 |
| JP | 2011-60491 | A | 3/2011 |
| JP | 2011-096496 | A | 5/2011 |

OTHER PUBLICATIONS

Written Opinion (PCT/ISA/237) mailed on Jun. 26, 2012, by the Japanese Patent Office as the International Searching Authority for International Application No. PCT/JP2012/064158.

* cited by examiner

GAS CIRCUIT BREAKER

FIELD

The present invention relates to a gas circuit breaker that is applied to an electric power system for power generation, power transformation, and the like, and that blocks an electric current by using insulating gas such as sulfur hexafluoride (SF6) gas having high arc-extinguishing properties.

BACKGROUND

In a general gas circuit breaker, it is necessary to use a material having both high electrical insulating properties and high mechanical strength for an insulating operation rod that supports or drives a puffer blocking unit. As an insulating material, a resin material has better electrical insulating properties. However, a required mechanical strength cannot be sufficiently obtained from this resin material alone. Therefore, as a material for the insulating operation rod, fiber reinforced plastic (FRP), obtained by soaking fibers in resin, is generally used. Among various kinds of fiber reinforced plastic, glass fiber reinforced plastic (GFRP) is frequently used for the insulating operation rod, particularly because GFRP has better manufacturability and workability.

When SF6 gas is decomposed by an arc generated at the time of blocking an electric current, active SF4 gas is generated. This SF4 gas reacts with water in a hermetically-sealed tank, and is hydrolyzed to SOF4 gas and HF gas. Glass fibers in a GFRP insulating operation rod are damaged by decomposition gas such as this HF gas. There is a possible reduction in mechanical strength of the glass fibers in this insulating operation rod. Further, it is known that the surface resistance of the insulating operation rod is reduced by an influence of a conductive substance generated by a reaction of the glass fibers with the decomposition gas, and this eventually leads to creeping destruction of the insulating operation rod.

In a conventional technique disclosed in Patent Literature 1 as a method for solving these problems, a GFRP surface is coated by a coating having a high resistance to decomposition gas (a decomposition-gas resistant coating) to prevent a reduction in mechanical strength and electrical insulating properties of glass fibers.

CITATION LIST

Patent Literature

Patent Literature 1: Japanese Patent Application Laid-open No. 2006-333567

SUMMARY

Technical Problem

However, the typical conventional technique in Patent Literature 1 mentioned above has the following problems. In the conventional technique, the surface of the insulating operation rod is coated by a decomposition-gas resistant coating to prevent glass fibers from being damaged. However, in a case where the insulating operation rod is formed into a pipe shape, and therefore has a small inner diameter and a large longitudinal length, it is difficult to apply a decomposition-gas resistant coating to the inner peripheral surface of the insulating operation rod. Particularly, in order to satisfy predetermined insulating performance, it is necessary to apply the decomposition-gas resistant coating evenly to the inner peripheral surface. For example, double coating is necessary. A significant amount of time and effort is required to apply a desired thickness of the decomposition-gas resistant coating to the inner-diameter portion of the insulating operation rod so as to satisfy predetermined insulating performance. Therefore, there is a problem in that the manufacturing cost is comparatively increased.

The present invention has been achieved to solve the above problems, and an object of the present invention is to provide a gas circuit breaker that can achieve a cost reduction while satisfying predetermined blocking performance.

Solution to Problem

In order to solve the aforementioned problems, a gas circuit breaker according to one aspect of the present invention is constructed in such a manner as to include: a hermetically-sealed tank that is filled with insulating gas; a blocking unit that is configured by a movable contact and a fixed contact that are located opposed to each other in this hermetically-sealed tank; a first operation rod that is provided with the movable contact at one end thereof and moves this movable contact; an insulating operation rod that has a cylindrical shape, that is coupled with the other end of the first operation rod, and that electrically insulates the first operation rod from the hermetically-sealed tank and moves the first operation rod; a second operation rod that is coupled with the other end of the insulating operation rod and moves the insulating operation rod; and an insulating cylindrical member that has a bottomed cylindrical shape, and that is provided in an inner-diameter portion of the insulating operation rod, wherein the first operation rod includes a large-diameter portion that is formed on a side of the movable contact, and a small-diameter portion that is formed on a side of the insulating operation rod relative to the large-diameter portion, and that is formed with an outer diameter smaller than an inner diameter of an inner peripheral surface of the insulating cylindrical member, and the insulating cylindrical member includes a cylindrical portion that is interposed between an outer peripheral surface of the small-diameter portion and an inner peripheral surface of the insulating operation rod, a bottom portion that is arranged opposed to a distal end of the small-diameter portion, and a through hole through which a coupling pin is inserted through the first operation rod and the insulating operation rod.

Advantageous Effects of Invention

According to the present invention, a gas shut-off member is provided at the end of an insulating operation rod to keep an inner peripheral portion of the insulating operation rod airtight. Therefore, the present invention can achieve a cost reduction while satisfying predetermined insulating performance.

BRIEF DESCRIPTION OF DRAWINGS

FIG. 4 is a diagram showing a gas shut-off member according to a third embodiment of the present invention.

DESCRIPTION OF EMBODIMENTS

Exemplary embodiments of a gas circuit breaker according to the present invention will be explained below in detail with reference to the accompanying drawings. The present invention is not limited to the embodiments.

First Embodiment

Figure 1:
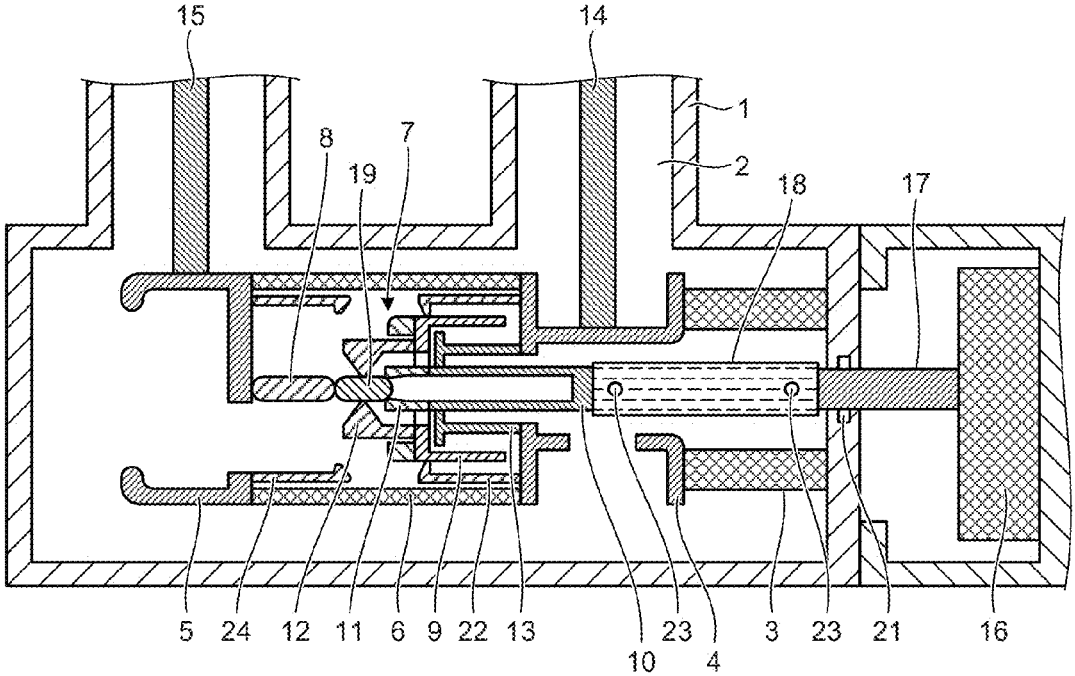
FIG. 1 is a vertical cross-sectional view showing a configuration of a gas circuit breaker.
Figure 2:
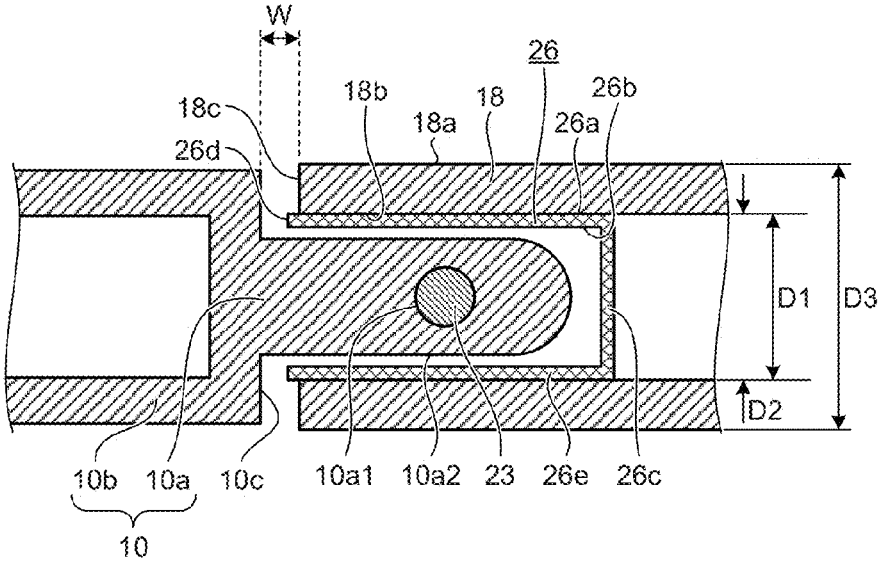
FIG. 2 is a diagram showing a gas shut-off member according to a first embodiment of the present invention.

FIG. 1 is a vertical cross-sectional view showing a configuration of a gas circuit breaker. FIG. 1 shows an example of the gas circuit breaker to which a gas shut-off member according to first to fifth embodiments of the present invention can be applied. FIG. 2 is a diagram showing a gas shut-off member according to the first embodiment of the present invention. A hermetically-sealed tank 1 shown in FIG. 1 is filled with arc-extinguishing insulating gas 2 such as SF6 gas. A puffer blocking unit 7 that blocks an electric current is configured to include a fixed contact 8 that is electrically connected to a fixed-side frame 5, a movable contact 11 that is coaxially opposed to the fixed contact 8, a puffer cylinder 9, an insulating-material nozzle 12 that is fixed to the puffer cylinder 9, and a piston 13 that is fixed to a movable-side frame 4.

The movable-side frame 4 is supported by an insulating support cylinder 3 that is provided inside of the hermetically-sealed tank 1. The fixed-side frame 5 is supported by the movable-side frame 4 through an interpolar insulator 6. The movable contact 11 is electrically connected to the movable-side frame 4 and a movable-side cylindrical conductor 22 through the puffer cylinder 9. The fixed contact 8 is electrically connected to the fixed-side frame 5.

On the side surface of the hermetically-sealed tank 1, a hole is provided through which an operation rod (a seal rod 17) is inserted. In this hole, a gasket 21 is provided to keep the interior of the hermetically-sealed tank 1 airtight. The seal rod 17 is inserted through the side surface of the hermetically-sealed tank 1 through the gasket 21. One end of the seal rod 17 is connected to a drive device 16, and the other end is connected to an insulating operation rod 18. In the following explanations, the insulating operation rod 18 is simply referred to as "rod 18". There are larger errors in the manufacturing of the rod 18 as compared with metallic members such as a piston rod 10 and the seal rod 17. Assuming that the rod 18 is inserted through the hermetically-sealed tank 1, it is difficult to maintain airtightness in the hermetically-sealed tank 1. Therefore, the seal rod 17 is inserted through the hermetically-sealed tank 1 because of its smaller manufacturing errors than the rod 18.

The rod 18 is made of GFRP, and has a cylindrical shape, for example. In order to prevent a reduction in mechanical strength and electrical insulating properties of glass fibers, a decomposition-gas resistant coating is coated on an outer peripheral surface 18*a* (see FIG. 2) of the rod 18. It is desirable to apply a decomposition-gas resistant coating also on an axial end surface 18*c* (see FIG. 2) of the rod 18 in the same manner as on the outer peripheral surface 18*a*.

A bushing center conductor 14 is connected to the movable-side frame 4. A bushing center conductor 15 is connected to the fixed-side frame 5. The puffer blocking unit 7 is energized through the bushing center conductors 14 and 15. The puffer blocking unit 7 is electrically insulated from the hermetically-sealed tank 1 by the insulating support cylinder 3. The movable contact 11 is configured to reciprocate in the axial-line direction in relation to the operation of the piston rod 10, the rod 18, and the seal rod 17. Specifically, one end of the movable contact 11 comes into and out of contact with the fixed contact 8, and the other end is connected to the piston rod 10. One end of the piston rod 10 is connected to the movable contact 11, and the other end is coupled with the rod 18 by a coupling pin 23. One end of the rod 18 is coupled with the piston rod 10, and the other end is coupled with the seal rod 17 by the coupling pin 23.

An operation of the gas circuit breaker when it blocks an electric current is explained below. A driving force, applied to the seal rod 17 by the drive device 16 that is arranged outside of the hermetically-sealed tank 1, is transmitted to the puffer blocking unit 7 through the rod 18. The rod 18 is interposed between the piston rod 10 and the seal rod 17, and therefore when the puffer blocking unit 7 moves toward the drive device 16, the rod 18 electrically insulates the seal rod 17 from the hermetically-sealed tank 1. When the puffer blocking unit 7 moves toward the drive device 16, an arc 19 is generated as the movable contact 11 and the fixed contact 8 come out of contact from each other. Upon this operation of the puffer blocking unit 7, the arc-extinguishing insulating gas 2 that is present in the space between the puffer cylinder 9 and the piston 13 is compressed. The arc-extinguishing insulating gas 2 compressed as described above is sprayed on the arc 19 through the insulating-material nozzle 12, thereby extinguishing the arc 19 and blocking an electric current.

With reference to FIG. 2, the gas shut-off member according to the first embodiment of the present invention is explained below. FIG. 2 shows a cross section of a connection portion between the rod 18 and the piston rod 10. The piston rod 10 has a cylindrical shape and is made of metal, for example. The piston rod 10 is constituted by a large-diameter portion 10*b* that is arranged on the side of the movable contact 11, and a small-diameter portion 10*a* that is arranged on the side of the rod 18 and that has a smaller diameter than the outer diameter of the large-diameter portion 10*b*.

The small-diameter portion 10*a* is formed with a size to be insertable into the inner peripheral portion of an insulating cylindrical member 26 described later. In the following explanations, the insulating cylindrical member 26 is simply referred to as "cylindrical member 26". For example, the small-diameter portion 10*a* is formed with an outer diameter equal to or smaller than the inner diameter of an inner peripheral surface 26*b* of the cylindrical member 26. Further, the small-diameter portion 10*a* is formed with a certain axial length such that the distal end of the small-diameter portion 10*a* does not come into contact with a bottom portion 26*c* of the cylindrical member 26 when the small-diameter portion 10*a* and the rod 18 are integrally connected by the coupling pin 23. Between the large-diameter portion 10*b* and the small-diameter portion 10*a*, an axial end surface 10*c* is provided opposed to the axial end surface 18*c* of the rod 18. In FIG. 2, the small-diameter portion 10*a* is formed with an outer diameter smaller than the inner diameter of the cylindrical member 26. However, the present invention is not limited thereto, and the small-diameter portion 10*a* can be formed with an outer diameter that is substantially the same as the inner diameter of the cylindrical member 26.

In the small-diameter portion 10*a*, a through hole 10*a*1 is formed at a predetermined position in an area extending from the axial end surface 10*c* toward the rod 18. The through hole 10*a*1 is a hole through which the coupling pin 23 passes, and is provided in a direction perpendicular to the axial line of the small-diameter portion 10*a*. In the rod 18, a through hole (not shown) is formed at a predetermined position in an area extending from the axial end surface 18*c* toward the axial center of the rod 18. This through hole is a hole similar to the through hole 10*a*1, through which the coupling pin 23 passes, and is provided in a direction perpendicular to the axial line of the small-diameter portion 10*a*. The position of these through holes is not limited to the position shown in FIG. 2.

The cylindrical member 26 is provided in the rod 18. The cylindrical member 26 has a bottomed cylindrical shape, and is made of an insulating material such as fluororesin (PTFE) or epoxy resin. The cylindrical member 26 is formed such that an outer peripheral surface 26*a* of a cylindrical portion 26*e* comes into contact with an inner peripheral surface 18*b* of the rod 18. For example, the outer peripheral surface 26*a* is formed with an outer diameter D2 that is substantially the same as an inner diameter D1 of the inner peripheral surface 18*b*. The bottom portion 26*c* that closes one end of the cylindrical portion 26*e* is provided in the cylindrical member 26. The cylindrical member 26 is inserted into the rod 18 from the axial end surface 18*c* before the piston rod 10 is inserted into the rod 18. Thereafter, the small-diameter portion 10*a* of the piston rod 10 is inserted into the cylindrical member 26 from its opening end.

In the cylindrical portion 26*e*, a through hole (not shown) is formed through which the coupling pin 23 passes in the same manner as in the rod 18. For example, this through hole is formed at a predetermined position in an area extending from an opening-end-side end surface 26*d* toward the axial center of the rod 18. By inserting the coupling pin 23 into the through hole 10*a*1, the through hole (not shown) of the rod 18, and the through hole (not shown) of the cylindrical member 26, the rod 18 and the piston rod 10 are coupled with each other, and the cylindrical member 26 is held at a position where the distal end of the small-diameter portion 10*a* does not come into contact with the bottom portion 26*c*.

There are larger errors in the manufacturing of the rod 18 as compared to the piston rod 10 and the like. Therefore, in a case where the cylindrical member 26 is manufactured without taking the larger manufacturing errors into consideration, there is a possibility that when the cylindrical member 26 is fitted in the rod 18, the axial end surface 18*c* contacts the axial end surface 10*c* before the respective through holes are positioned coaxially, and therefore the coupling pin 23 cannot pass through these through holes. From the viewpoint of preventing the problem as described above, the respective through holes of the rod 18 and the piston rod 10 are provided in such a manner as to create approximately a several millimeters of gap W between the axial end surface 18*c* and the axial end surface 10*c* of the piston rod 10.

Further, in a case where the cylindrical member 26 is manufactured without taking the errors in the manufacturing of the rod 18 into consideration, there is a possibility that when the cylindrical member 26 is fitted in the rod 18, the axial end surface 18*c* protrudes from the opening-end-side end surface 26*d* toward the axial end surface 10*c*. In this case, there is a possibility that the inner peripheral surface 18*b* of the protruding portion of the axial end surface 18*c* is damaged by decomposition gas. From the viewpoint of preventing the damage as described above, the cylindrical member 26 shown in FIG. 2 is formed such that the opening-end-side end surface 26*d* protrudes from the axial end surface 18*c* toward the axial end surface 10*c*.

As described above, in the gas circuit breaker according to the first embodiment, the cylindrical member 26 that closes the inner-diameter portion of the rod 18 is provided. Therefore, decomposition gas, which enters the rod 18 from the opening of the axial end surface 18*c* of the rod 18, contacts the inner peripheral surface 26*b* of the cylindrical member 26, however, the decomposition gas does not contact the inner peripheral surface 18*b* of the rod 18. Accordingly, the possibility that the inner peripheral surface 18*b* is damaged by decomposition gas can be reduced. In the conventional technique, it is necessary to apply a decomposition-gas resistant coating evenly to the inner peripheral surface 18*b* in order to satisfy predetermined insulating performance. Consequently, there is a problem in that its work cost is comparatively increased. In the gas circuit breaker according to the first embodiment, in a case where a reduced amount of decomposition-gas resistant coating is applied to the inner peripheral surface 18*b*, or even in a case where this work is omitted, it is possible to realize the rod 18 having better decomposition-gas resistant performance and high electrical insulating performance. As a result, a high-voltage, large-capacity, and highly-reliable gas circuit breaker that can achieve a cost reduction while satisfying predetermined insulating performance, can be obtained.

Further, the bottom portion 26*c* is provided in the cylindrical member 26, which means that an insulator is interposed between the rod 18 and the distal end of the small-diameter portion 10*a*. Therefore, even in a case where a flashover occurs in the hermetically-sealed tank 1 for example, electric discharge between the rod 18 and the distal end of the small-diameter portion 10*a* is suppressed, and it is possible to achieve an improvement in withstand voltage performance.

As explained above, the gas circuit breaker according to the first embodiment includes the hermetically-sealed tank 1 that is filled with the arc-extinguishing insulating gas 2, the puffer blocking unit 7 that is configured by the movable contact 11 and the fixed contact 8 that are located opposed to each other in the hermetically-sealed tank 1, a first operation rod (the piston rod 10) that is provided with the movable contact 11 at one end thereof and moves the movable contact 11, the rod 18 that has a cylindrical shape, that is coupled with the other end of the first operation rod, and that electrically insulates the first operation rod from the hermetically-sealed tank 1 and moves the first operation rod, a second operation rod (the seal rod 17) that is coupled with the other end of the rod 18 and moves the rod 18, and the cylindrical member 26 that has a bottomed cylindrical shape, and is provided in the inner-diameter portion of the rod 18, wherein the piston rod 10 includes the large-diameter portion 10*b* that is formed on the side of the movable contact 11, and the small-diameter portion 10*a* that is formed on the side of the rod 18 relative to the large-diameter portion 10*b*, and that is formed with an outer diameter smaller than the inner diameter of the inner peripheral surface 26*b* of the cylindrical member 26, and the cylindrical member 26 includes the cylindrical portion 26*e* that is interposed between the outer peripheral surface of the small-diameter portion 10*a* and the inner peripheral surface of the rod 18, the bottom portion 26*c* that is arranged opposed to the distal end of the small-diameter portion 10*a*, and a through hole through which the coupling pin 23 is inserted through the piton rod 10 and the rod 18. Therefore, in a case where a reduced amount of decomposition-gas resistant coating is applied to the inner peripheral surface 18*b*, or even in a case where this work is omitted, it is possible to realize the rod 18 having better decomposition-gas resistant performance and high electrical insulating performance. As a result, a high-voltage, large-capacity, and highly-reliable gas circuit breaker that can achieve a cost reduction while satisfying predetermined insulating performance, can be obtained. Further, the bottom portion 26*c* is provided in the cylindrical member 26. Therefore, even in a case where a flashover occurs, electric discharge between the rod 18 and the distal end of the small-diameter portion 10*a* is suppressed, and it is possible to achieve an improvement in withstand voltage performance.

Second Embodiment

Figure 3:
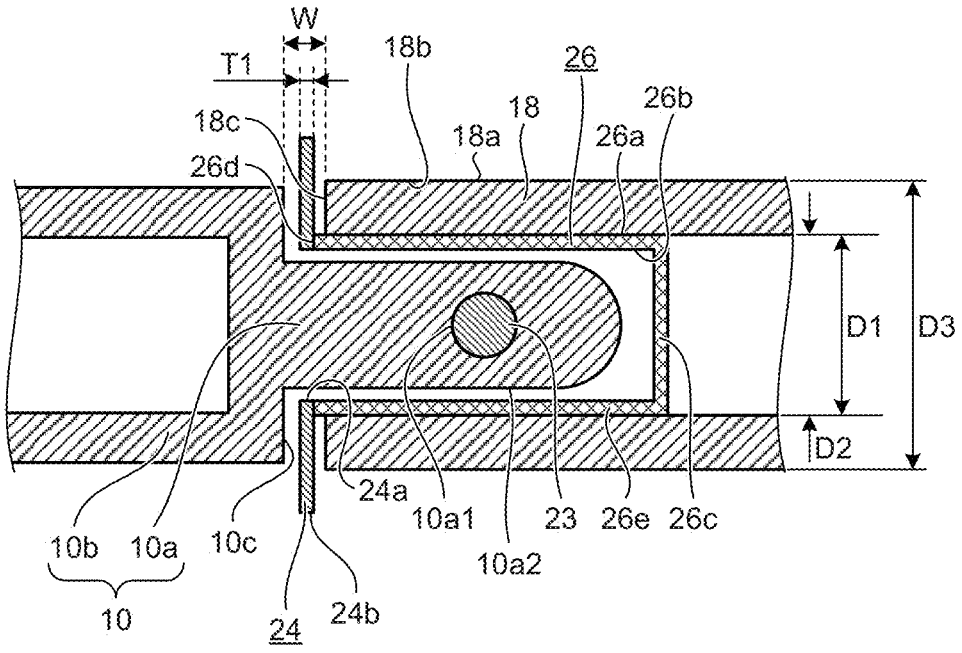
FIG. 3 is a diagram showing a gas shut-off member according to a second embodiment of the present invention.

FIG. 3 is a diagram showing a gas shut-off member according to the second embodiment of the present invention. The difference between the first embodiment and the second embodiment is that an annular member 24 is provided between the opening-end-side end surface 26*d* and the axial end surface 10*c*. In the following explanations, elements identical to those of the first embodiment are designated by like reference signs and explanations thereof will be omitted. Only elements different from those of the first embodiment are described below.

The annular member 24 has an annular plate shape, and is formed with dimensions such that the inner diameter of an inner peripheral surface 24*a* is larger than the diameter of the small-diameter portion 10*a*, and is smaller than the inner diameter D1 of the rod 18. An outer peripheral surface 24*b* of the annular member 24 is formed with an outer diameter larger than an outer diameter D3 of the rod 18, for example. The annular member 24 is formed with a thickness T1 smaller than the dimension of the gap W. For example, the annular member 24 can be made of the same insulating material as the cylindrical member 26 or can be made of metal. The annular member 24 is provided for the purpose of, for example, preventing high-temperature decomposition gas, which flows from the side of the rod 18 at a high velocity, from directly striking the axial end surface 18*c* and the like.

The shape of the annular member 24 is not limited to the shape as described above. For example, the annular member 24 can be formed with an outer diameter that is approximately the same as the outer diameter D3 of the rod 18. Also in a case of using the annular member 24 formed as described immediately above, decomposition gas does not intensively strike the axial end surface 18*c*. Therefore, it is possible to improve the decomposition-gas resistant performance and electrical insulating performance of the rod 18 as compared to the first embodiment.

As explained above, in the gas circuit breaker according to the second embodiment, the annular member 24, in which the inner peripheral surface 24*a* is formed with an inner diameter equal to or larger than the outer diameter of the small-diameter portion 10*a*, is provided in the gap W between the axial end surface 10*c* of the large-diameter portion 10*b* and the axial end surface 18*c* of the rod 18. Therefore, decomposition gas can be prevented from directly striking the axial end surface 18*c* and the like, and it is possible to further improve the decomposition-gas resistant performance and electrical insulating performance of the rod 18.

Third Embodiment

FIG. 4 is a diagram showing a gas shut-off member according to the third embodiment of the present invention. The difference between the second embodiment and the third embodiment is that an annular member 24-1 is provided instead of the cylindrical member 26 and the annular member 24. In the following explanations, elements identical to those of the second embodiment are designated by like reference signs and explanations thereof will be omitted. Only elements different from those of the above embodiments are described below.

For example, the annular member 24-1 is made of an elastic material (such as fluororesin) with lower elasticity than the rod 18, and an inner peripheral surface 24*a*-1 is formed with an inner diameter that is substantially the same as the diameter of an outer peripheral surface 10*a*2 of the small-diameter portion 10*a*. In the annular member 24-1, an outer peripheral surface 24*b*-1 is formed with an outer diameter larger than the outer diameter D3 of the rod 18. The annular member 24-1 is formed with a thickness T2 larger than the dimension of the gap W.

As shown in FIG. 4, when the small-diameter portion 10*a* is coupled with the rod 18, an axial end surface 24*c*-1 of the annular member 24-1, which is opposed to the axial end surface 18*c*, is pressed by the axial end surface 18*c* and deformed into a concave shape that is recessed toward the axial end surface 10*c*. Therefore, the boundary portion between the axial end surface 24*c*-1 and the axial end surface 18*c* is deformed into a labyrinth shape that is capable of suppressing the entry of decomposition gas into the inner-diameter portion of the rod 18. Accordingly, the decomposition-gas entry path becomes longer than that obtained before the axial end surface 24*c*-1 is pressed, thereby improving the airtightness between the axial end surface 18*c* and the axial end surface 24*c*-1.

Further, when the small-diameter portion 10*a* is coupled with the rod 18, the annular member 24-1 is pressed by the axial end surface 18*c*, and is also slightly expanded in a radial direction. This makes the inner diameter of the inner peripheral surface 24*a*-1 smaller, and improves the airtightness between the outer peripheral surface 10*a*2 and the inner peripheral surface 24*a*-1. Furthermore, when the small-diameter portion 10*a* is coupled with the rod 18, an axial end surface 24*d*-1 of the annular member 24-1 is pressed against the axial end surface 10*c* by an axial pressing force applied from the axial end surface 18*c*. This improves the airtightness between the axial end surface 24*d*-1 of the annular member 24-1 and the axial end surface 10*c*.

As described above, by providing the annular member 24-1, the entry of high-temperature decomposition gas, which flows from the side of the rod 18 at a high velocity, into the inner-diameter portion of the rod 18 can be suppressed. Therefore, it is possible to more improve the decomposition-gas resistant performance and electrical insulating performance of the rod 18.

The shape of the annular member 24-1 is not limited to the shape shown in FIG. 4. It suffices that at least the annular member 24-1 is made of an elastic material with lower elasticity than the rod 18, and is formed with the thickness T2 lager than the dimension of the gap W. With this configuration, the entry of decomposition gas into the inner-diameter portion of the rod 18 can be suppressed, and the manufacturing cost of the annular member 24-1 can be reduced.

The small-diameter portion 10*a* shown in FIG. 4 is formed such that the outer-diameter dimension on the base side is different from the outer-diameter dimension on the distal-end side. It is desirable that the outer peripheral surface 10*a*2 on the base side is machined with a high degree of precision, such that the outer diameter on the base side is substantially the same as the inner diameter of the inner peripheral surface 24*a*-1 in order to improve the airtightness between the inner peripheral surface 24*a*-1 of the annular member 24-1 and the outer peripheral surface 10*a*2. It is because the outer peripheral surface 10*a*2 on the distal-end side is not required to be as airtight as on the base side, and therefore can be relatively roughly machined. By using the annular member 24-1, it suffices that only a part of the outer peripheral surface 10*a*2 is machined with a high degree of precision. This makes it possible to reduce the manufacturing cost of the piston rod 10.

It is possible to use the annular member 24-1 in combination with the cylindrical member 26. In this case, the possibility for decomposition gas to enter into the inner-diameter portion of the rod 18 can be further reduced. Therefore, it is possible to improve the decomposition-gas resistant performance and electrical insulating performance of the rod 18 as compared to the first and second embodiments.

As explained above, in the gas circuit breaker according to the third embodiment, the annular member 24-1 is provided in the gap W between the axial end surface 10*c* of the large-diameter portion 10*b* and the axial end surface 18*c* of the rod 18, where the annular member 24-1 is made of an elastic material with lower elasticity than the rod 18, and is formed with the thickness T2 larger than the dimension of the gap W. Therefore, the entry of decomposition gas into the inner-diameter portion of the rod 18 can be suppressed, and it is possible to more improve the decomposition-gas resistance performance and electrical insulating performance of the rod 18.

Fourth Embodiment

Figure 5:
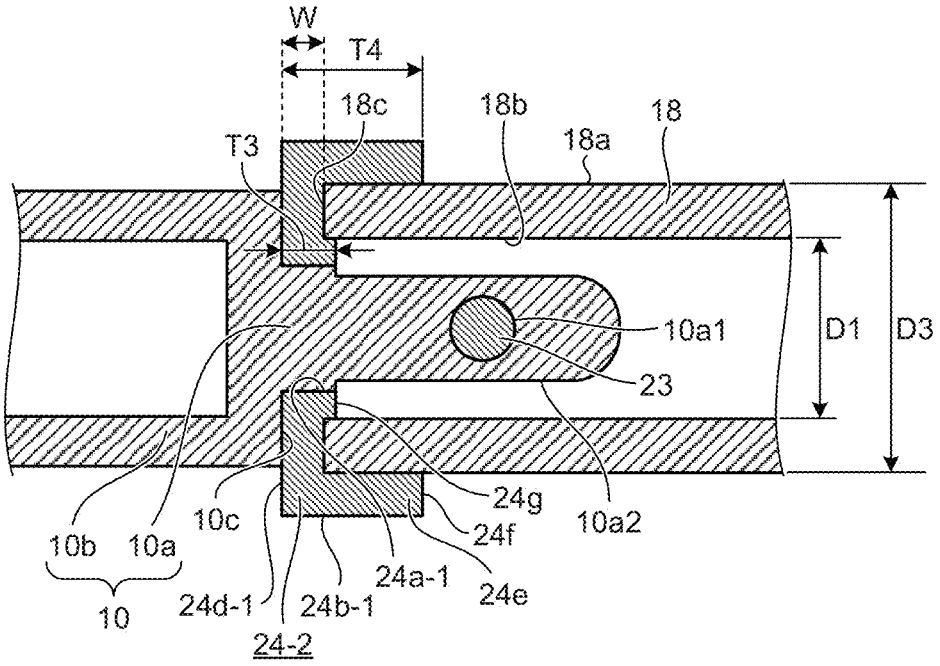
FIG. 5 is a diagram showing a gas shut-off member according to a fourth embodiment of the present invention.

FIG. 5 is a diagram showing a gas shut-off member according to the fourth embodiment of the present invention. The difference between the third embodiment and the fourth embodiment is that an annular member 24-2 is used instead of the annular member 24-1. In the following explanations, elements identical to those of the third embodiment are designated by like reference signs and explanations thereof will be omitted. Only elements different from those of the above embodiments are described below.

For example, the annular member 24-2 is made of an elastic material (such as fluororesin) with lower elasticity than the insulating operation rod 18. A surface of the annular member 24-2, which is opposed to the axial end surface 18*c*, is formed into a bottomed concave shape that is recessed toward the piston rod 10. In the annular member 24-2, an inner-peripheral-side bottom portion 24*g* is formed with a thickness T3 larger than the dimension of the gap W. An outer peripheral edge 24*e* that surrounds the outer peripheral surface 18*a* of the rod 18 and that protrudes toward the rod 18 side is formed on the outer peripheral side of the annular member 24-2. A thickness T4 from the axial end surface 24*d*-1 to an axial end surface 24*f* of the outer peripheral edge 24*e* is formed larger than the thickness T3.

When the small-diameter portion 10*a* is coupled with the rod 18, the inner-peripheral-side bottom portion 24*g* is pressed by the axial end surface 18*c* and deformed into a concave shape that is recessed toward the axial end surface 10*c*. Because the outer peripheral surface 18*a* of the rod 18 is covered by the outer peripheral edge 24*e*, the decomposition-gas entry path becomes longer than that obtained from the annular member 24-1 shown in FIG. 4. Therefore, the airtightness between the axial end surface 18*c* and the annular member 24-2 can be improved as compared to the third embodiment, and it is possible to further improve the decomposition-gas resistant performance and electrical insulating performance of the rod 18.

It is possible to use the annular member 24-2 in combination with the cylindrical member 26. In this case, the possibility for decomposition gas to enter into the inner-diameter portion of the rod 18 can be further reduced. Therefore, it is possible to improve the decomposition-gas resistant performance and electrical insulating performance of the rod 18 as compared to the first to third embodiments.

As explained above, in the gas circuit breaker according to the fourth embodiment, the outer peripheral surface 24*b*-1 of the annular member 24-2 is formed with an outer diameter larger than the outer diameter D3 of the rod 18, and in the annular member 24-2, the outer peripheral edge 24*e* is provided, which extends toward the rod 18 and surrounds the outer peripheral surface 18*a* of the rod 18. Therefore, the decomposition-gas entry path becomes longer than that in the third embodiment, the airtightness between the axial end surface 18*c* and the annular member 24-2 can be improved, and it is possible to further improve the decomposition-gas resistant performance and electrical insulating performance of the rod 18.

Fifth Embodiment

Figure 6:
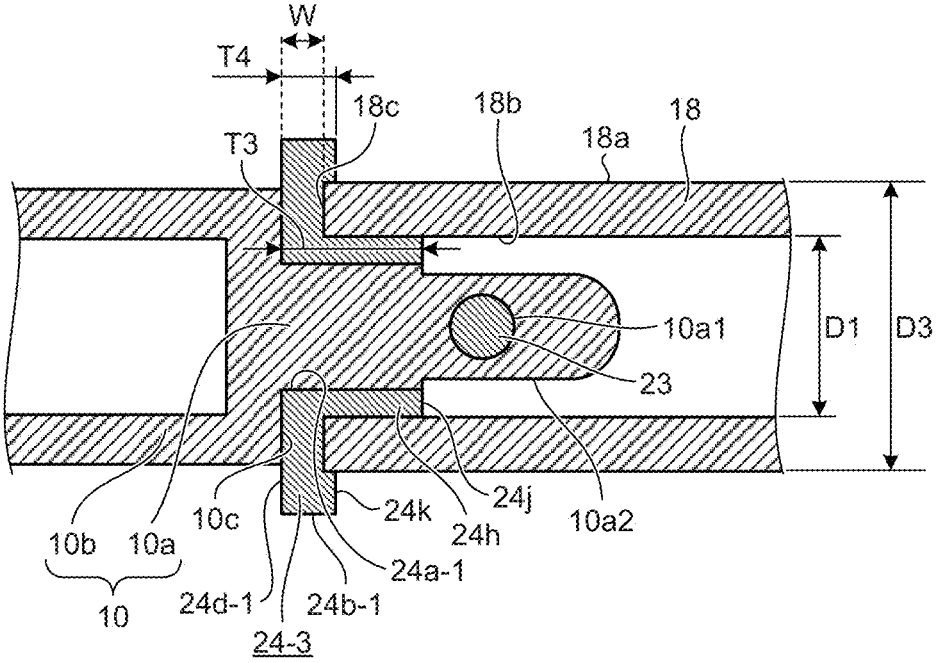
FIG. 6 is a diagram showing a gas shut-off member according to a fifth embodiment of the present invention.

FIG. 6 is a diagram showing a gas shut-off member according to the fifth embodiment of the present invention. The difference between the third embodiment and the fifth embodiment is that an annular member 24-3 is used instead of the annular member 24-1. In the following explanations, elements identical to those of the third embodiment are designated by like reference signs and explanations thereof will be omitted. Only elements different from those of the above embodiments are described below.

For example, the annular member 24-3 is made of an elastic material (such as fluororesin) with lower elasticity than the insulating operation rod 18. A surface of the annular member 24-3, which is opposed to the axial end surface 18*c*, is formed into a bottomed concave shape that is recessed toward the piston rod 10. In the annular member 24-3, an outer-peripheral-side bottom portion 24*k* is formed with a thickness T4 larger than the dimension of the gap W. On the inner peripheral side of the annular member 24-3, an inner peripheral edge 24*h* is formed, which is interposed between the inner peripheral surface 18*b* of the rod 18 and the outer peripheral surface 10*a*2 of the small-diameter portion 10*a*, and which protrudes toward the rod 18. The thickness T3 from the axial end surface 24*d*-1 to an axial end surface 24*j* of the inner peripheral edge 24*h* is formed larger than the thickness T4.

When the small-diameter portion 10*a* is coupled with the rod 18, the outer-peripheral-side bottom portion 24*k* is pressed by the axial end surface 18*c* and deformed into a concave shape that is recessed toward the axial end surface 10*c*. Because the inner peripheral edge 24*h* is interposed between the inner peripheral surface 18*b* and the outer peripheral surface 10*a*2, the decomposition-gas entry path becomes longer than that obtained from the annular member 24-1 shown in FIG. 4. Therefore, the airtightness between the axial end surface 18*c* and the annular member 24-3 can be more improved as compared to the third embodiment, and it is possible to more improve the decomposition-gas resistant performance and electrical insulating performance of the rod 18.

It is possible to use the annular member 24-3 in combination with the cylindrical member 26. In this case, the possibility for decomposition gas to enter into the inner-diameter portion of the rod 18 can be further reduced. Therefore, it is possible to improve the decomposition-gas resistant performance and electrical insulating performance of the rod 18 as compared to the first to third embodiments.

As explained above, in the gas circuit breaker according to the fifth embodiment, the inner peripheral surface 24*a*-1 of the annular member 24-3 is formed with an inner diameter smaller than the inner diameter D1 of the rod 18, and in the annular member 24-3, the inner peripheral edge 24*h* is provided, which extends toward the rod 18 and is interposed between the outer peripheral surface of the small-diameter portion 10*a* and the inner peripheral surface 18*b* of the rod 18. Therefore, the decomposition-gas entry path becomes longer than that in the third embodiment, the airtightness between the axial end surface 18*c* and the annular member 24-3 can be improved, and it is possible to further improve the decomposition-gas resistant performance and electrical insulating performance of the rod 18.

In the first to fifth embodiments, there has been explained the configuration example, in which the cylindrical member 26 is provided in the rod 18 on the side of the piston rod 10 for the purpose of blocking high-temperature decomposition gas, which flows from the side of the rod 18 shown in FIG. 1 at a high velocity, from entering into the inner-diameter portion of the rod 18. However, the position of the cylindrical member 26 is not limited thereto, and the cylindrical member 26 can be additionally provided in the inner-diameter portion of the rod 18 on the side of the seal rod 17. That is, in the gas circuit breaker according to the first to fifth embodiments, the seal rod 17 includes a large-diameter portion (corresponding to the large-diameter portion 10*b*) that is formed on the opposite side to the rod 18, and a small-diameter portion (corresponding to the small-diameter portion 10*a*) that is formed on the side of the rod 18 relative to this large-diameter portion, and that is formed with an outer diameter smaller than the inner diameter of the inner peripheral surface 26*b* of the cylindrical member 26, and the cylindrical member 26 includes a cylindrical portion (corresponding to the cylindrical portion 26*e*) that is interposed between the outer peripheral surface of this small-diameter portion and the inner peripheral surface of the rod 18, a bottom portion (corresponding to the bottom portion 26*c*) that is arranged opposed to the distal end of this small-diameter portion, and a through hole through which the coupling pin 23 is inserted through the seal rod 17 and the rod 18. Therefore, as compared to the case where the cylindrical member 26 is provided in the rod 18 only on the side of the piston rod 10, it is possible to more improve the decomposition-gas resistant performance and electrical insulating performance of the rod 18.

Further, it is possible to use the annular member 24-1 alone, not in combination with the cylindrical member 26. That is, in the gas circuit breaker according to this embodiment, the piston rod 10 includes the large-diameter portion 10*b* and the small-diameter portion 10*a*, and the annular member 24-1 is provided in the gap W, where the annular member 24-1 is made of an elastic material with lower elasticity than the rod 18, and is formed with the thickness T2 larger than the dimension of the gap W. Therefore, similarly to the first embodiment, the possibility for decomposition gas to enter into the inner-diameter portion of the rod 18 can be reduced, and it is possible to improve the decomposition-gas resistant performance and electrical insulating performance of the rod 18. The same applies to the annular member 24-2 and the annular member 24-3.

Further, the annular member 24-1 can be additionally provided in the rod 18 on the side of the seal rod 17. That is, in the gas circuit breaker according to this embodiment, the seal rod 17 includes a large-diameter portion (corresponding to the large-diameter portion 10*b*) that is formed on the opposite side to the rod 18, and a small-diameter portion (corresponding to the small-diameter portion 10*a*) that is formed on the side of the rod 18 relative to this large-diameter portion, and that is formed with an outer diameter smaller than the inner diameter of the inner peripheral surface 18*b* of the rod 18, and in a gap between the axial end surface of the large-diameter portion of the seal rod 17 and the axial end surface of the rod 18, an annular member (corresponding to the annular member 24-1) is provided, which is made of an elastic material with lower elasticity than the rod 18, and which is formed with a thickness larger than the dimension of this gap. Therefore, as compared to the case where the annular member 24-1 is provided in the rod 18 only on the side of the piston rod 10, it is possible to more improve the decomposition-gas resistant performance and electrical insulating performance of the rod 18. The same applies to the annular member 24-2 and the annular member 24-3.

The gas circuit breaker according to the embodiments of the present invention is only an example of the contents of the present invention and can be combined with other well-known techniques. It is needless to mention that the present invention can be configured while modifying it without departing from the scope of the invention, such as omitting a part the configuration.

INDUSTRIAL APPLICABILITY

As described above, the present invention can be applicable to a gas circuit breaker, and is particularly useful as an invention that can achieve a cost reduction while satisfying predetermined blocking performance.

REFERENCE SIGNS LIST

1 hermetically-sealed tank
2 arc-extinguishing insulating gas (insulating gas)
3 insulating support cylinder
4 movable-side frame
5 fixed-side frame
6 interpolar insulator
7 puffer blocking unit (blocking unit)
8 fixed contact
9 puffer cylinder
10 piston rod (first operation rod)
10*a* small-diameter portion
10*a*1 through hole
10*a*2, 18*a*, 24*b*, 24*b*-1, 26*a* outer peripheral surface
10*b* large-diameter portion
10*c*, 18*c*, 24*c*-1, 24*d*-1, 24*f*, 24*j* axial end surface
11 movable contact
12 insulating-material nozzle
13 piston
14, 15 bushing center conductor
16 drive device
17 seal rod (second operation rod)
18 insulating operation rod
18*b*, 24*a*, 24*a*-1, 26*b* inner peripheral surface
19 arc
21 gasket
23 coupling pin
24, 24-1, 24-2, 24-3 annular member
24*e* outer peripheral edge
24*g* inner-peripheral-side bottom portion
24*h* inner peripheral edge
24*k* outer-peripheral-side bottom portion
26 insulating cylindrical member
26*c* bottom portion
26*d* opening-end-side end surface
26*e* cylindrical portion

The invention claimed is:

1. A gas circuit breaker comprising:

a hermetically-sealed tank that is filled with insulating gas;

a blocking unit that is configured by a movable contact and a fixed contact that are located opposed to each other in this hermetically-sealed tank;

a first operation rod that is provided with the movable contact at one end thereof and moves this movable contact;

an insulating operation rod that has a cylindrical shape, that is coupled with another end of the first operation rod on a first side of the insulating operation rod, and that electrically insulates the first operation rod from the hermetically-sealed tank and moves the first operation rod;

a second operation rod, that is coupled with an end of the insulating operation rod on a second side of the insulating operation rod that is opposite to the first side of the insulating operation rod, and that moves the insulating operation rod; and an insulating cylindrical member that has a bottomed cylindrical shape, and that is provided in an inner-diameter portion of the insulating operation rod, wherein the first operation rod includes a large-diameter portion that is formed on a side of the movable contact, and a small-diameter portion that is formed on a side of the insulating operation rod relative to the large-diameter portion, and that is formed with an outer diameter smaller than an inner diameter of an inner peripheral surface of the insulating cylindrical member, and the insulating cylindrical member includes a cylindrical portion that is interposed between an outer peripheral surface of the small-diameter portion and an inner peripheral surface of the insulating operation rod, a bottom portion that is arranged opposed to a distal end of the small-diameter portion, and a through hole through which a coupling pin is inserted through the first operation rod and the insulating operation rod.

2. The gas circuit breaker according to claim 1, wherein in a gap between an axial end surface of the large-diameter portion and an axial end surface of the insulating operation rod, an annular member, the inner peripheral surface of which is formed with an inner diameter equal to or larger than an outer diameter of the small-diameter portion, is provided.

3. The gas circuit breaker according to claim 1, wherein in a gap between an axial end surface of the large-diameter portion and an axial end surface of the insulating operation rod, an annular member is provided, which is made of an elastic material with lower elasticity than the insulating operation rod, and is formed with a thickness larger than a dimension of the gap.

4. The gas circuit breaker according to claim 3, wherein an outer peripheral surface of the annular member is formed with an outer diameter larger than an outer diameter of the insulating operation rod, and in this annular member, an outer peripheral edge is provided, which extends toward the insulating operation rod and surrounds an outer peripheral surface of the insulating operation rod.

5. The gas circuit breaker according to claim 3, wherein an inner peripheral surface of the annular member is formed with an inner diameter smaller than an inner diameter of the insulating operation rod, and in this annular member, an inner peripheral edge is provided, which extends toward the insulating operation rod and is interposed between the outer peripheral surface of the small-diameter portion and the inner peripheral surface of the insulating operation rod.

6. The gas circuit breaker according to claim 1, wherein the second operation rod includes a large-diameter portion that is formed on an opposite side to the insulating operation rod, and a small-diameter portion that is formed on the side of the insulating operation rod relative to this large-diameter portion, and that is formed with an outer diameter smaller than the inner diameter of the inner peripheral surface of the insulating cylindrical member, and the insulating cylindrical member includes a cylindrical portion that is interposed between an outer peripheral surface of this small-diameter portion and the inner peripheral surface of the insulating operation rod, a bottom portion that is arranged opposed to a distal end of this small-diameter portion, and a through hole through which a coupling pin is inserted through the second operation rod and the insulating operation rod.

7. A gas circuit breaker comprising:

a hermetically-sealed tank that is filled with insulating gas;

a blocking unit that is configured by a movable contact and a fixed contact that are located opposed to each other in this hermetically-sealed tank;

a first operation rod that is provided with the movable contact at one end thereof and moves this movable contact;

an insulating operation rod that has a cylindrical shape, that is coupled with another end of the first operation rod on a first side of the insulating operation rod, and that electrically insulates the first operation rod from the hermetically-sealed tank and moves the first operation rod; and a second operation rod, that is coupled with an end of the insulating operation rod on a second side of the insulating operation rod that is opposite to the first side of the insulating operation rod, and that moves the insulating operation rod, wherein the first operation rod includes a large-diameter portion that is formed on a side of the movable contact, and a small-diameter portion that is formed on a side of the insulating operation rod relative to the large-diameter portion, and that is formed with an outer diameter smaller than an inner diameter of an inner peripheral surface of the insulating operation rod, and in a gap between an axial end surface of the large-diameter portion and an axial end surface of the insulating operation rod, an annular member is provided, which is made of an elastic material with lower elasticity than the insulating operation rod, and is formed with a thickness larger than a dimension of the gap.

8. The gas circuit breaker according to claim 7, wherein an outer peripheral surface of the annular member is formed with an outer diameter larger than an outer diameter of the insulating operation rod, and in this annular member, an outer peripheral edge is provided, which extends toward the insulating operation rod and surrounds an outer peripheral surface of the insulating operation rod.

9. The gas circuit breaker according to claim 7, wherein an inner peripheral surface of the annular member is formed with an inner diameter smaller than an inner diameter of the insulating operation rod, and in this annular member, an inner peripheral edge is provided, which extends toward the insulating operation rod and is interposed between the outer peripheral surface of the small-diameter portion and the inner peripheral surface of the insulating operation rod.

10. The gas circuit breaker according to claim 7, wherein the second operation rod includes a large-diameter portion that is formed on an opposite side to the insulating operation rod, and a small-diameter portion that is formed on the side of the insulating operation rod relative to this large-diameter portion, and that is formed with an outer diameter smaller than the inner diameter of the inner peripheral surface of the insulating operation rod, and in a gap between an axial end surface of the large-diameter portion of the second operation rod and an axial end surface of the insulating operation rod, an annular member is provided, which is made of an elastic material with lower elasticity than the insulating operation rod, and which is formed with a thickness larger than a dimension of this gap.

* * * * *